US007729503B2

(12) United States Patent
Young

(10) Patent No.: US 7,729,503 B2
(45) Date of Patent: Jun. 1, 2010

(54) ARMORED VOICE COIL ASSEMBLY FOR USE IN HIGH POWER LOUDSPEAKER APPLICATIONS

(75) Inventor: Larry J. Young, Paducah, KY (US)

(73) Assignee: Acoustic Design, Inc., Paducah, KY (US)

( * ) Notice: Subject to any disclaimer, the term of this patent is extended or adjusted under 35 U.S.C. 154(b) by 977 days.

(21) Appl. No.: 11/494,491

(22) Filed: Jul. 28, 2006

(65) Prior Publication Data

US 2007/0025586 A1 Feb. 1, 2007

Related U.S. Application Data

(60) Provisional application No. 60/703,009, filed on Jul. 28, 2005.

(51) Int. Cl.
*H04R 25/00* (2006.01)

(52) U.S. Cl. ..... 381/407; 381/409; 381/410

(58) Field of Classification Search ..... 381/396, 381/400, 401, 402, 403, 407, 409, 410; 29/594, 29/602.1, 605, 609.1
See application file for complete search history.

(56) References Cited

U.S. PATENT DOCUMENTS

| | | | | |
|---|---|---|---|---|
| 2,235,654 | A * | 3/1941 | Steers | 381/403 |
| 3,935,402 | A | 1/1976 | Gersten | |
| 4,188,711 | A * | 2/1980 | Babb | 29/594 |
| 4,225,757 | A * | 9/1980 | Babb | 381/407 |
| 4,539,442 | A | 9/1985 | Puls et al. | |
| 5,027,412 | A | 6/1991 | Hayashi et al. | |
| 5,091,028 | A | 2/1992 | Yamazaki et al. | |
| 5,832,096 | A | 11/1998 | Hall | |
| 6,654,476 | B1 | 11/2003 | Guenther | |
| 6,721,435 | B2 | 4/2004 | Babb et al. | |
| 6,867,374 | B2 | 3/2005 | Ishigaki et al. | |
| 2002/0064292 | A1 | 5/2002 | Rombach et al. | |
| 2004/0071308 | A1 | 4/2004 | Guenther | |
| 2004/0076842 | A1 | 4/2004 | Ishigaki et al. | |
| 2004/0191621 | A1 | 9/2004 | Heller, Jr. | |

FOREIGN PATENT DOCUMENTS

| | | |
|---|---|---|
| JP | 54-118817 | 9/1979 |
| JP | 58-075399 | 5/1983 |
| JP | 60-001999 | 1/1985 |
| JP | 60-219898 | 11/1985 |
| JP | 62-137997 | 6/1987 |
| JP | 63-146597 | 6/1988 |
| JP | 64-041600 | 2/1989 |
| JP | 02-237395 | 9/1990 |
| JP | 03-083499 | 4/1991 |
| JP | 06-121388 | 4/1994 |
| JP | 07-245800 | 9/1995 |
| JP | 08-107597 | 4/1996 |
| JP | 10-210594 | 8/1998 |
| JP | 2001-359192 | 12/2001 |

* cited by examiner

*Primary Examiner*—Huyen D Le
(74) *Attorney, Agent, or Firm*—J. Andrew McKinney, Jr.

(57) ABSTRACT

An armored voice coil assembly comprises a former that is impregnated with a curable resin, preferably polyimide resin. Voice coil wire is wound around the outside surface of the former and is then preferably encased with an outer layer of resin impregnated glass fabric wrapped around the voice coil windings, effectively enveloping the voice coil within inner and outer layers of fabric and resin. The armored voice coil assembly is then cured into a solid shape.

20 Claims, 4 Drawing Sheets

ARMORED VOICE COIL ASSEMBLY FOR USE IN HIGH POWER LOUDSPEAKER APPLICATIONS

CROSS-REFERENCE TO RELATED APPLICATIONS

The present application claims priority to and the benefit, under 35 U.S.C. 119(e), of U.S. Provisional Application No. 60/703,009 filed on Jul. 28, 2005, the entire contents of which are incorporated herein by reference.

BACKGROUND OF THE INVENTION

1. Field of the Invention

The present invention relates to electromechanical loudspeaker motor structures, and, more particularly, to an armored voice coil assembly and methods for making armored voice coil assemblies for use in high power, long excursion loudspeaker applications.

2. Description of Related Art

Recent market emphasis on long excursion, high power dissipation loudspeakers (e.g., low frequency drivers or woofers) has challenged manufacturers to make products which will withstand previously unimaginable levels of abuse. DB drag races and other forms of loudness-level competition have created markets for amplifiers and loudspeakers dissipating several kilowatts (kW) for extended periods of time. Such products have been incorporated in auto sound systems generating acoustic outputs exceeding one hundred seventy decibels (170 dB) before failing.

Loudspeakers have well understood limitations. In particular, high power signals drive a speaker's diaphragm or cone into extreme excursions and can cause the usually pistonic motion of the diaphragm to become mis-aligned when driven by more challenging audio signals. Typical prior art woofers utilize circular baskets supporting frustoconical driver diaphragms having a circular peripheral edge carrying an annular surround or suspension. Customarily, the circular small end of the frustoconical diaphragm supports a substantially cylindrical voice coil former upon which is wound a conductive voice coil having positive and negative terminal ends.

Conventional woofers utilize supportive baskets which closely follow the frustoconical shape of the driver diaphragm and support the motor magnet and the circular diaphragm surround in a co-axial alignment, permitting the axial movement of the diaphragm in response to electrical excitation of the voice coil.

Loudspeaker or woofer failure can be often attributed to thermal or mechanical overloading problems. Substantial amounts of power are required to provide competition-winning sound pressure levels, and signals having such power require very large current flow through voice coil conductors, thus generating substantial amounts of heat and driving the woofer's diaphragm to extreme excursions. Those extreme excursions generate extreme mechanical loads on the diaphragm and its supportive suspension. In competitions, operators seek the loudest possible playback and often overdrive the loudspeaker drivers, causing voice coils to burn out or open circuit. Such extreme use may also cause mechanical failure of the cone, the surround, the "spider" suspension member, or, when a moving, mis-aligned voice coil rubs the motor's annular gap edge, failure of the voice coil.

There is a need, therefore, for a voice coil adapted to withstand the abuse encountered in modern high-power long-excursion loudspeaker applications.

When assembling loudspeakers, one critical alignment step usually adds substantially to the cost and duration of the assembly operation. The loudspeaker motor must be assembled with the substantially cylindrical voice coil located precisely and concentrically in an annular motor gap. The cone and voice coil are usually part of a first assembly that is lowered into a second assembly comprising a motor and basket. If the assembler mis-aligns the voice coil in the annular magnetic gap, the voice coil may contact or rub the magnetic gap's edge, thereby causing distortion or failure of the loudspeaker. The criticality of this alignment increases the cost of assembling loudspeakers.

There is also a need, therefore, for a voice coil assembly adapted to permit a less critical and costly loudspeaker assembly process.

BRIEF SUMMARY OF THE INVENTION

Accordingly, the present invention overcomes the above-mentioned difficulties in at least two ways. First, the present invention provides a protected or armored voice coil assembly adapted to withstand high-excursion, high power loudspeaker applications. Second, the present invention provides an armored voice coil assembly adapted to permit a less critical and costly loudspeaker assembly process. These improved characteristics are achieved individually and in combination, and it is not intended that the present invention be construed as requiring two or more of these advantages to be combined.

The armored voice coil assembly of the present invention includes, in a first embodiment, a former comprising a porous substrate substantially impregnated or saturated with a curable resin. A coil of wire is wound or placed upon an outside or inside surface of the former and is then encased within a stiffener wrapped around the coil of wire. In loudspeaker applications, this coil of wire is known as the voice coil. The stiffener is preferably a porous substrate substantially impregnated or saturated with a curable resin. The outer, enveloping stiffener is also referred to as the armor layer. Preferably, this process effectively envelopes the coil of wire within an inner and outer layer of fabric and resin. The former and the stiffener are preferably co-extensive, having the same cylindrical length along their shared axis. The finished armored voice coil assembly, once cured into a selected shape, is then preferably drilled with a plurality of spaced thru holes penetrating the sidewall of the armored voice coil assembly permitting ventilation or fluid communication between the interior and the exterior of the armored voice coil assembly.

The coil of wire has a first and second coil end that is preferably soldered to flat, ribbon shaped conductor ends that can be laid flat against a sidewall of the former emerging from the armored voice coil assembly's proximal end, so that the armor or stiffener protects the coil's connecting conductors from the side.

In a preferred embodiment, the armored voice coil assembly advantageously obtains structural integrity and stiffness from at least two substantially coaxial cylindrical walls, each cylindrical layer can be thinner and can therefore be a better thermal conductor, as compared to thicker, conventional voice coil formers.

The preferred armored voice coil assemblies are manufactured using the following process. First, a strip of a porous substrate impregnated with a curable resin is wound around a mandrel or tool. Second, a coil of wire is directly wrapped or placed on an interior or exterior surface of the former using no other traditional coil-to-form adhesive coatings. As noted above, preferably, the coil of wire has a first and second coil end that are soldered to flat, ribbon shaped conductor ends that can be lain flat against a sidewall of the former to emerge from a selected end of the former, so that, in use, the armor or stiffener protects the coil's connecting conductors from the side. Third, the exposed side of the coil of wire is then covered or wrapped in a stiffener, thereby forming a jacket or an armor protecting the coil of wire. Next, the armored voice coil assembly is baked or cured to fuse the former, coil of wire and stiffener into an integral, unitary solid form. After the fusing step, a plurality of thru holes may be punched or drilled into the sidewall of the assembly at a plurality of locations selected to avoid the conductors encased within the armored voice coil assembly.

Multi-layered armored voice coil assemblies can have an interior or exterior coil of wire on a former with other coils of wire within or around the stiffener, finishing with added stiffeners to cover, protect and insulate exposed coil windings in a selected number of former-coil-stiffener-coil-stiffener-coil-stiffener, etc laminations, so long as each coil is encased between either (a) a former and stiffener, or (b) a pair of stiffener layers.

Multi-layered armor voice coil assemblies may be used, for example, in multi-voice coil drivers such as woofers, or in drivers intended to provide selected drive or impedance characteristics. Depending on the application, the multi-layered armored voice coils can be aligned along the axis in an overlapping orientation or can be disposed at differing positions in relation to a selected end of the former, for differing orientations to a selected driver's magnetic gap, once installed. The coils of wire can also be of identical or differing axial lengths, can comprise identical or differing winding conductors (e.g., differing material, gauge/size or shape), and can have identical or differing numbers of windings or wraps, to provide selected drive or impedance characteristics.

In use, armored voice coil assemblies can withstand higher operating temperatures and can also withstand, for a time, misalignment and resultant rubbing against the motor gap edge, since the coil's conductors are protected from damage by the stiffener or armor layer.

BRIEF DESCRIPTION OF THE SEVERAL VIEWS OF THE DRAWINGS

The features and advantages of the present invention will become apparent from the following detailed description of several preferred embodiments thereof, taken in conjunction with the accompanying drawings, in which.

DETAILED DESCRIPTION OF THE INVENTION

Figure 1:
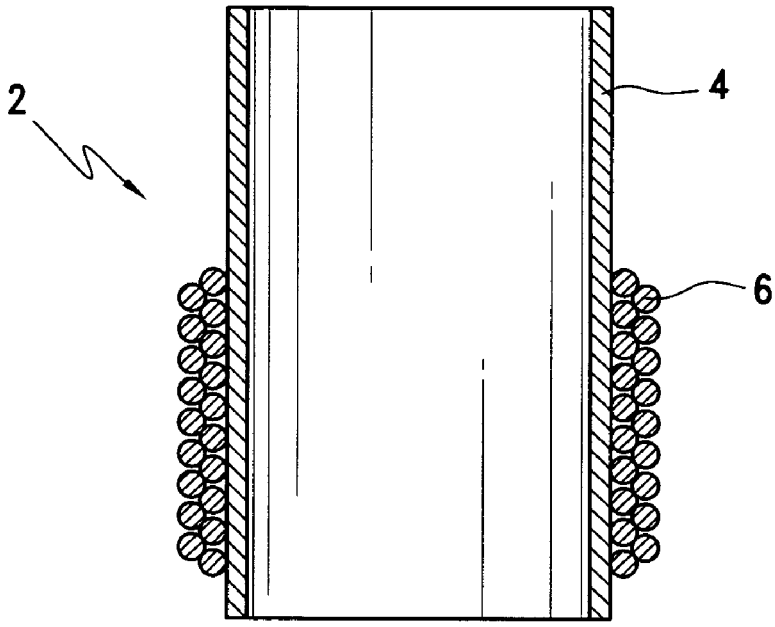
FIG. 1 Prior Art
FIG. 1 shows, in partial cross section and elevation, a conventional voice coil wound on a conventional cylindrical voice coil former.
Figure 2:
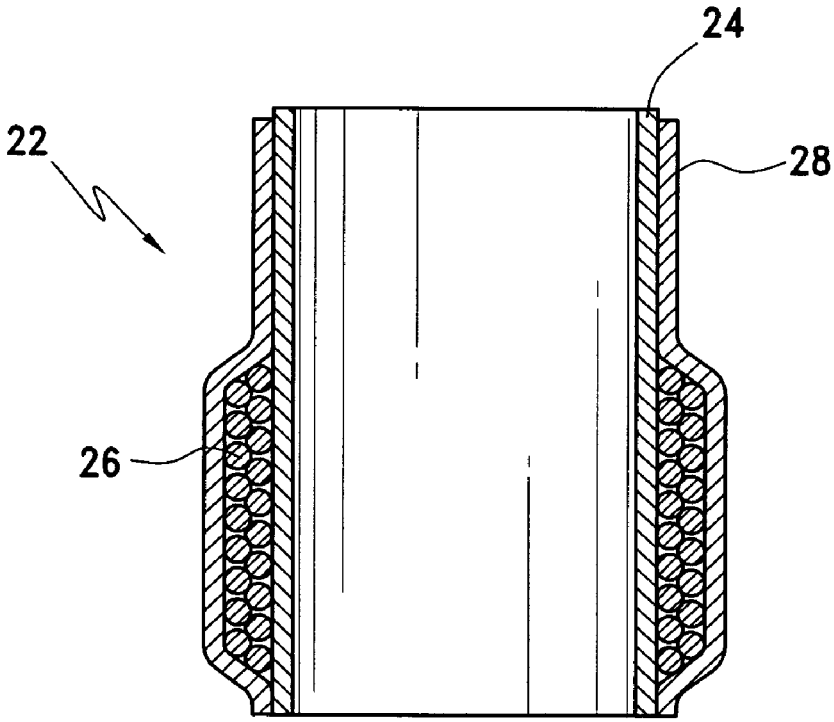
FIG. 2 illustrates, in partial cross section and elevation, an armored voice coil assembly having a cylindrical former and an armored outer covering or stiffener, in accordance with the present invention.

As illustrated in FIG. 1, a conventional voice coil 2 for use in a loudspeaker driver includes a cylindrical former 4 upon which is wrapped a plurality of turns of conductive wire to form a coil 6. The former 4 carries the coil 6 in a selected orientation for suspension in a driver motor's magnetic gap.

FIGS. 2-7 illustrate a few exemplary embodiments of the armored voice coil assembly of the present invention. Beginning with the embodiment of FIG. 2, an armored voice coil assembly 22 includes a former 24. The former 24 is tubular having a continuous wall with an exterior and interior surface forming a hollow interior. FIGS. 2-7 show a preferred cylindrical shape for the former 24. However, it is understood by one of ordinary skill in the art that the former 24 can be in any cross sectional shape. The former 24 is preferably made from a porous absorbent substrate impregnated with a curable resin. A variety of material may be selected as the porous absorbent substrate including, but not limited to, glass cloth material, para-aramid fiber (i.e. KEVLAR®) fiber material, or even a carbon fiber material. The former 24 is substantially impregnated or saturated with the curable resin. A variety of curable resins may be used including, but not limited to, a liquid or gel polyimide resin. It is understood that any reference to a former throughout this application refers to formers as just described. A coil of wire 26 is wound around the outside surface of the former 24 and is then encased with an outer layer or stiffener 28 wrapped around the coil of wire 26. The stiffener 28 is also a porous absorbent substrate impregnated with a curable resin. The porous absorbent substrate is selected from the materials previously identified. Additionally, the curable resin is selected from the resins previously identified. In a preferred embodiment, the stiffener is glass fabric material impregnated or saturated with a liquid or gel polyimide resin. It is understood that any reference to a stiffener throughout this application refers to stiffeners as just described. This process effectively envelopes the coil of wire 26 between the former 24 and stiffener 18. The outer, enveloping layer of stiffener 28 is also referred to as the armor layer. Preferably, former 24 and stiffener 28 are co-extensive having the same cylindrical length along their shared axis on the completed armored voice coil assembly 22. The armored voice coil assembly 22 is preferably fused or cured into a solid cylindrical shape.

Figure 3:
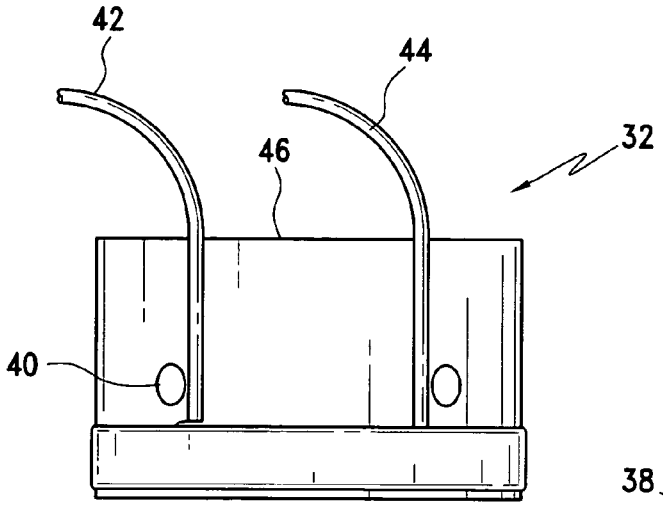
FIG. 3 illustrates, in elevation, a second embodiment of the armored voice coil assembly, in accordance with the present invention.
Figure 4:
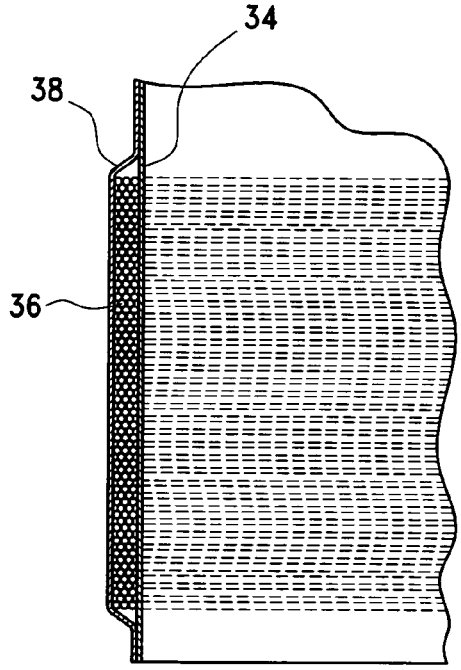
FIG. 4 illustrates, in partial cross section and elevation, an enlarged detailed view of the armored voice coil assembly of FIG. 3, in accordance with the present invention.

FIG. 3 and FIG. 4 show a second embodiment of the armored voice coil assembly 32, having a former 34 as defined previously. FIG. 4 is an enlarged detailed view of a side wall of the armored voice coil assembly 32 shown in FIG. 3. As stated previously, the former 34 is preferably made from a glass fabric that is substantially impregnated or saturated with polyimide resin. A coil of wire 36 is wound around an outside surface of the former 34 and is then encased with a stiffener 38 as defined previously. In a preferred embodiment, this provides a layer of polyimide resin impregnated glass fabric wrapped around the coil of wire 36, effectively enveloping the coil of wire 36 within inner and outer layers of fabric and resin. Once the armored voice coil assembly 32 is cured, a plurality of spaced apertures or thru holes 40 is preferably drilled to penetrate the armored voice coil assembly 32. In a preferred embodiment, seven thru holes 40 are evenly spaced around the circumference of the armored voice coil assembly 32. These thru holes 40 provide fluid communication between the interior and exterior of the armored voice coil assembly 32. The coil of wire 36 has a first and a second coil end that is preferably soldered to flat, ribbon shaped conductor ends 42, 44 that can be laid flat against the sidewall of the former 34, emerging from a proximal end 46 of the armored voice coil assembly 32. This allows the armor or stiffener 38 to protect the coil's connecting conductors from the side. Advantageously, since the armored voice coil assembly 32 obtains structural integrity and stiffness from at least two substantially coaxial cylindrical walls 34, 36 each cylindrical layer can be thinner and can therefore be a better thermal conductor, as compared to thicker, conventional voice coil formers.

Figure 5:
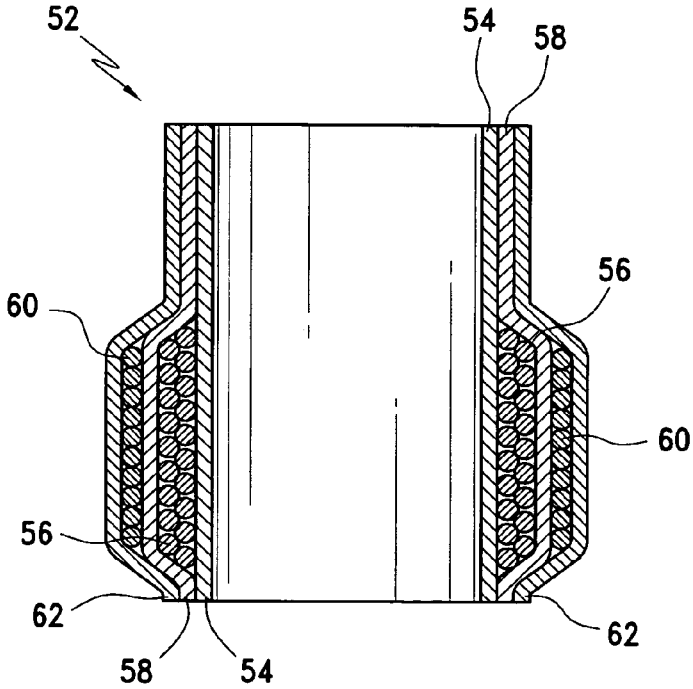
FIG. 5 illustrates, in partial cross section and elevation, a multi-layered armored voice coil assembly, in accordance with the present invention.

A multi-layer armored voice coil assembly 52 is shown in FIG. 5 and includes a former 54 as previously defined. A first coil of wire 56 is wrapped or placed upon an exterior surface of former 54. The first coil of wire 56 is then encased within a first stiffener 58 as previously defined. This process effectively envelopes the first coil of wire 56 within inner and outer layers of fabric and resin. A second coil of wire 60 is wrapped or placed upon an exterior surface of stiffener 58 and is encased within a second stiffener 62. The second stiffener 62 is preferably selected from the stiffeners previously defined. This process effectively envelopes the second coil of wire 60 within inner and outer layers of fabric and resin.

Figure 6:
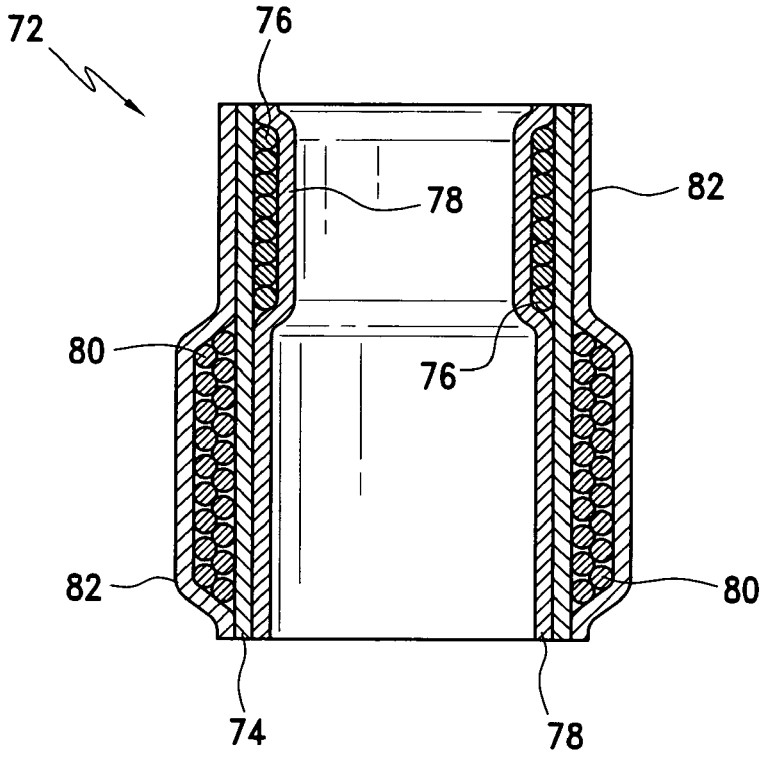
FIG. 6 illustrates, in partial cross section and elevation, another multi-layered armored voice coil assembly, in accordance with the present invention.
Figure 7:
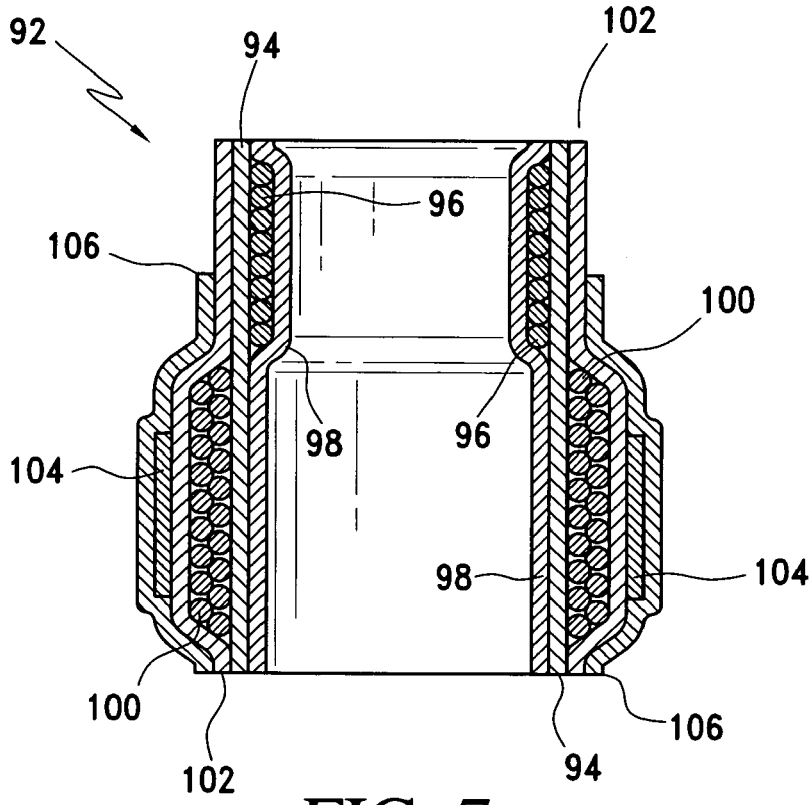
FIG. 7 illustrates, in partial cross section and elevation, another multi-layered armored voice coil assembly, in accordance with the present invention.

Multi-layered armored voice coil assemblies can have an interior, as shown in FIGS. 6 and 7, or exterior, as shown in FIGS. 5 and 7, coil of wire on a former with other coils of wire within or around a layer of a stiffener, finishing with added stiffeners to cover, protect and insulate exposed coils of wire in a selected number of former-coil-stiffener-coil-stiffener-coil-stiffener, etc laminations, so long as each coil of wire is encased between either (a) a former and stiffener, or (b) a pair of stiffener layers.

FIG. 6 illustrates another embodiment of a multi-layered armored voice coil assembly 72. A former 74 as previously defined and an inner coil of wire 76 is placed within an interior surface of the former 74. The inner coil of wire 76 is then encased within an inner stiffener 78. The inner stiffener 78 is selected from the stiffeners previously defined. This process effectively envelopes the inner coil of wire 76 within inner and outer layers of fabric and resin. An outer coil of wire 80 is wound or placed upon an exterior surface of the former 74. The outer coil of wire 80 is then encased within an outer stiffener 82. The outer stiffener 82 is selected from the stiffeners previously defined. This process effectively envelopes the outer coil of wire 80 within inner and outer layers of fabric and resin.

FIG. 7 illustrates yet another multi-layered armored voice coil assembly 92 and includes a former 94 as previously defined. A first inner coil of wire 96 is wrapped or placed on an interior surface of former 94. The first inner coil of wire 96 is then encased within an inner stiffener 98. The inner stiffener 98 is selected from the stiffeners previously defined. This process effectively envelopes the first inner coil of wire 96 within inner and outer layers of fabric and resin. A second coil of wire 100 is wrapped or placed upon an exterior surface of former 94 and is encased within a second stiffener 102. The second stiffener 102 is selected from the stiffeners previously defined. This process effectively envelopes the second coil of wire 100 within inner and outer layers of fabric and resin. A third coil of wire 104 is wrapped or placed upon an exterior surface of the second stiffener 102 and is encased within a third stiffener 106. The third stiffener 106 is selected from the stiffeners previously defined. This process effectively envelopes the third coil of wire 104 within inner and outer layers of fabric and resin.

The armored voice coil assemblies described above and included with this application are made using the following preferred manufacturing process. First, the former is made by winding a porous substrate impregnated in a curable resin around a mandrel or tool to form a hollow or tubular former having an exterior and interior surface. In a preferred embodiment of the present invention, the porous substrate includes, but is not limited to, a strip of glass cloth material, a para-aramid (i.e. KEVLAR®) fiber material, or even a carbon fiber material. In a preferred embodiment of the present invention, the curable resin includes, but is not limited to, a polyimide resin. As illustrated in the Figures presented in this application, the preferred shape of the mandrel or tool is substantially cylindrical. However, one of ordinary skill in the art would appreciate that other shapes may be used. Second, a coil of wire is wrapped or placed on or within the former when the former is impregnated or wet with the curable resin using no other traditional coil-to-former adhesive coating. The coil of wire is preferably an enameled conductor coil. In one preferred embodiment, a wound coil could be placed on or within the former. As noted above, preferably, the coil of wire has a first and second end that is soldered to flat, ribbon shaped conductor ends (e.g., 42 and 44, as in FIG. 3) that can be lain flat against the former sidewall to emerge from a selected end of the former (e.g., the proximal or free, distal end), so that, in use, the armor or stiffener protects the coil's connecting conductors from the side. Third, the exposed side of the coil of wire is then covered or wrapped in a second strip of a porous substrate impregnated with a curable resin, thereby forming a jacket or armor protecting the coil. As indicated above, the porous substrate preferably includes, but is not limited to, a strip of glass cloth material, KEVLAR® fiber material, or even a carbon fiber material. The curable resin preferably includes, but is not limited to, a polyimide resin. Next, the armored voice coil assembly is baked or cured to fuse the former, coil(s) of wire and stiffener(s) into an integral, unitary solid. After the fusing step, a plurality of venting thru holes (e.g., such as 40) may be punched or drilled into a sidewall of the armored voice coil assembly at a plurality of locations selected to avoid the conductors encased within the armored voice coil assembly.

Multi-layered armored voice coil assemblies can have an interior or exterior coil of wire on a former with other coils of wire within or around the stiffener, finishing with added stiffeners to cover, protect and insulate exposed coils of wire in a selected number of former-coil-stiffener-coil-stiffener-coil-stiffener, etc laminations, so long as each coil of wire is encased between either (a) a former and stiffener, or (b) a pair of stiffener layers.

Multi-layered voice coil assemblies may be used, for example, in multi-voice coil drivers such as woofers, or in drivers intended to provide selected drive or impedance characteristics. Depending on the application, the layered coils of wire can be aligned along the axis in an overlapping orientation or can be disposed at differing positions in relation to a selected end of the former, for differing orientations to a selected driver's magnetic gap, once installed. The coils of wire or voice coils can also be of identical or differing axial lengths, can comprise identical or differing winding conductors (e.g., differing material, gauge/size or shape), and can have identical or differing numbers of windings or wraps, to provide selected drive or impedance characteristics.

In use, armored voice coil assemblies can withstand higher operating temperatures and can also withstand, for a time, misalignment and resultant rubbing against the motor gap edge, since the coil's conductors are protected from damage by the armor layer or stiffener of a porous substrate impregnated with a curable resin.

Figure 8:
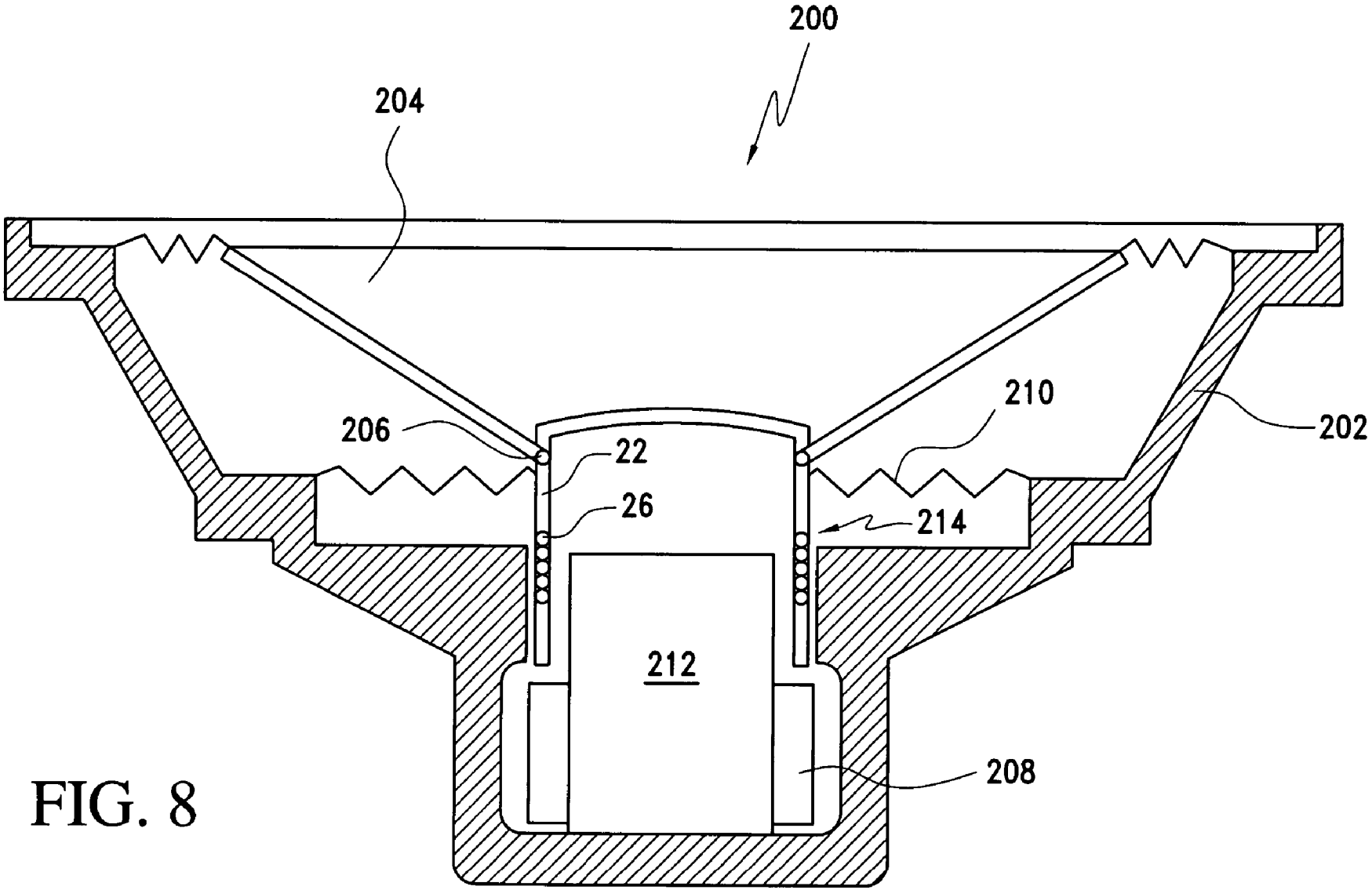
FIG. 8 illustrates, in partial cross section and elevation, a loudspeaker driver including an armored voice coil assembly, in accordance with the present invention.

Turning to FIG. 8, a loudspeaker driver 200 incorporating the armored voice coil of the present invention optionally includes a typical circular basket 202 supporting a frustoconical driver diaphragm 204, and customarily the small end 206 of diaphragm 204 supports a substantially cylindrical armored voice coil former 22 within which is wound conductive voice coil 26 having positive and negative terminal ends. Drivers optionally utilizes a basket 202 that closely follows the frustoconical shape of the driver diaphragm and supports a motor magnet 208 and the circular diaphragm surround or spider 210 in an axial alignment with pole piece 212, permitting an axial movement of the diaphragm in response to excitation of the armored voice coil 22. Loudspeaker driver 200 preferably includes one or more magnetic structures incorporating one or more permanent magnets (e.g., 208) to provide a magnetic flux that is concentrated across the magnetic gap 214, where the flux acts on the armored voice coil 22.

A common concern with such loudspeakers is driver failure due to thermal overloading problems, for substantial amounts of power are required to provide adequate sound pressure levels for many applications so high power sound outputs from the loudspeaker require very large current flows through voice coil conductor 26, and these currents generate heat in the voice coil, and the heat is dissipated through the former 24 and stiffener 28 to adjacent airspace and metal structures. Heat flowing through the former 24 is dissipated in part via the driver's pole piece 212, and heat flowing through the stiffener 28 is dissipated in part via the driver's pot or outer magnetic gap defining surface.

Any of the armored voice coils described in the exemplary embodiments above can be used in driver 200, and one or more drivers including armored voice coils can be incorporated into a loudspeaker system to provide enhanced power handling capacity and a very broad range of acceptable input driving signals. By way of example, a loudspeaker system including a woofer with more than one driven voice coil includes multilayer armored voice coil 92 while a midrange driver and one or more tweeters include the basic armored voice coil 22.

It will be appreciated by those of skill in the art that the voice coil former of the present invention can be made in a wide variety of configurations without departing from the scope of the invention. For purposes of nomenclature, "tubular", as used herein, is not limited to a former having a cylindrical shape or a circular cross section, but means a former or bobbin-like structure having an exterior wall surface that defines an interior lumen or interior volume, and so square, hexagonal or arbitrary (e.g., kidney) shaped tubular formers can be fabricated into armored voice coils, in accordance with the present invention. If, for example, a loudspeaker has a pole piece which, in cross section, resembles a five-sided rhombus, then an armored voice coil for that application would resemble a close-fitted five sided tube having a hollow interior sized to receive that pole piece.

Having described preferred embodiments of a new and improved method, it is believed that other modifications, variations and changes will be suggested to those skilled in the art in view of the teachings set forth herein. It is therefore to be understood that all such variations, modifications and changes are believed to fall within the scope of the present invention.

What is claimed is:

1. An armored voice coil assembly, comprising:

a tubular former having an exterior surface and an interior surface, wherein said tubular former comprises a porous absorbent substrate impregnated with a curable resin;

a first coil of wire applied to said exterior surface or said interior surface of said tubular former;

a first stiffener comprising a porous absorbent substrate impregnated with a curable resin applied to said first coil of wire; and wherein said tubular former, first coil of wire and first stiffener are fused together into an integral, unitary solid encapsulating said first coil of wire within an envelope defined by said tubular former and said first stiffener.

2. The armored voice coil assembly of claim 1, further comprising a second coil of wire applied to said first stiffener; and a second stiffener comprising a porous absorbent substrate impregnated with a curable resin applied to said second coil of wire, wherein said first stiffener, second coil of wire and second stiffener are fused together into an integral, unitary solid encapsulating said second coil of wire within a second envelope defined by said first stiffener and said second stiffener.

3. A loudspeaker comprising the armored voice coil assembly of claim 2.

4. The armored voice coil assembly of claim 1, wherein said first coil of wire is applied to the exterior surface of the tubular former.

5. The armored voice coil assembly of claim 4, further comprising a second coil of wire applied to the interior surface of the tubular former; and a second stiffener comprising a porous absorbent substrate impregnated with a curable resin applied to said second coil of wire, wherein said former, second coil of wire and second stiffener are fused together into an integral, unitary solid encapsulating said second coil of wire within a second envelope defined by said former and said second stiffener.

6. A loudspeaker comprising the armored voice coil assembly of claim 5.

7. A loudspeaker comprising the armored voice coil assembly of claim 4.

8. The armored voice coil assembly of claim 1, wherein said porous absorbent substrate is selected from the group consisting of glass cloth material, para-aramid fiber material, and carbon fiber material.

9. A loudspeaker comprising the armored voice coil assembly of claim 8.

10. The armored voice coil assembly of claim 1, wherein said curable resin is a polyimide resin.

11. A loudspeaker comprising the armored voice coil assembly of claim 10.

12. A loudspeaker comprising the armored voice coil assembly of claim 1.

13. A method for fabricating an armored voice coil assembly, comprising:

a) providing a tubular former having an exterior surface and an interior surface, wherein said tubular former comprises a porous absorbent substrate impregnated with a curable resin;

b) positioning a first coil of wire on said exterior surface or said interior surface of said tubular former;

c) applying a first stiffener comprising a porous absorbent substrate impregnated with a curable resin to said first coil of wire; and d) fusing said tubular former, first coil of wire and first stiffener together into an integral, unitary solid encapsulating said first coil of wire within an envelope defined by said tubular former and said first stiffener.

14. The method of claim 13, further comprising e) providing a second coil of wire applied to said first stiffener; and f) applying a second stiffener comprising a porous absorbent substrate impregnated with a curable resin to said second coil of wire; and g) fusing said first stiffener, second coil of wire and second stiffener together into an integral, unitary solid encapsulating said second coil of wire within an envelope defined by said first stiffener and said second stiffener.

15. The method of claim 13, wherein said first coil of wire is positioned on the exterior surface of the tubular former.

16. The method of claim 15, further comprising e) providing a second coil of wire applied to said interior surface of the tubular former; and f) applying a second stiffener comprising a porous absorbent substrate impregnated with a curable resin to said second coil of wire; and g) fusing said tubular former, second coil of wire and second stiffener together into an integral, unitary solid encapsulating said second coil of wire within an envelope defined by said former and said second stiffener.

17. The method of claim 13, further comprising:

(e) making ventilating thru-holes from said exterior surface through to said interior surface to provide fluid communication therewith.

18. The method of claim 13, wherein said step of providing a tubular former includes providing a tubular forming comprising a porous absorbent substrate selected from the group consisting of glass cloth material, para-aramid fiber material, and carbon fiber material.

19. The method of claim 13, wherein said step of providing a tubular former includes providing a tubular forming comprising a porous absorbent substrate impregnated with a curable polyimide resin.

20. The method of claim 13, further comprising soldering flat, ribbon shaped conductor ends to a first and second end of the first coil of wire; and covering said conductor ends with the second stiffener.

* * * * *